US008999912B2

(12) United States Patent
Lant

(10) Patent No.: US 8,999,912 B2
(45) Date of Patent: Apr. 7, 2015

(54) DETERGENT COMPOSITIONS

(75) Inventor: Neil Joseph Lant, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 1326 days.

(21) Appl. No.: 11/825,817

(22) Filed: Jul. 9, 2007

(65) Prior Publication Data

US 2010/0093591 A1 Apr. 15, 2010

(51) Int. Cl.
*C11D 3/386* (2006.01)
*C11D 3/40* (2006.01)
*C11D 3/42* (2006.01)

(52) U.S. Cl.
CPC ..... *C11D 3/38645* (2013.01); *C11D 3/40* (2013.01)

(58) Field of Classification Search
IPC ..... C11D 3/38645,3/38636, 3/40, 3/42
See application file for complete search history.

(56) References Cited

U.S. PATENT DOCUMENTS

| | | | |
|---|---|---|---|
| 4,945,053 | A | 7/1990 | Ito et al. |
| 6,638,902 | B2 | 10/2003 | Tarara et al. |
| 6,699,828 | B1 | 3/2004 | de Buzzaccarini et al. |
| 7,141,403 | B2 | 11/2006 | Outtrup et al. |
| 7,629,158 | B2 | 12/2009 | Perez-Prat Vinuesa et al. |
| 7,686,892 | B2 | 3/2010 | Smets et al. |
| 2004/0002431 | A1 | 1/2004 | Hakamada et al. |
| 2005/0148486 | A1 | 7/2005 | Schramm et al. |
| 2007/0179076 | A1 | 8/2007 | Gibson et al. |

FOREIGN PATENT DOCUMENTS

| | | | |
|---|---|---|---|
| EP | 265832 | | 10/1993 |
| EP | 1350843 | | 10/2003 |
| EP | 1 876 226 | B1 | 10/2008 |
| JP | 06 343 461 | | 12/1994 |
| JP | 00 063 889 | | 2/2000 |
| JP | 2000-178593 | A | 6/2000 |
| JP | 2001-059098 | A | 3/2001 |
| JP | 2006-030578 | | 2/2006 |
| JP | 2011-241031 | | 12/2011 |
| JP | 2011-241099 | | 12/2011 |
| WO | WO 00 27980 | | 5/2000 |
| WO | WO 0027980 | A1 | 5/2000 |
| WO | WO 01 00765 | A1 | 1/2001 |
| WO | WO 02/099091 | | 12/2002 |
| WO | WO 2004/053039 | | 6/2004 |
| WO | 2004/074419 | * | 9/2004 |
| WO | 2005/003274 | * | 1/2005 |
| WO | WO 2005/003274 | | 1/2005 |
| WO | WO 2005/003275 | | 1/2005 |
| WO | WO 2005/035707 | | 4/2005 |
| WO | WO 2005/068596 | | 7/2005 |
| WO | WO 2005 100531 | | 10/2005 |
| WO | WO 2006/055787 | A | 5/2006 |
| WO | WO 2007/144856 | | 12/2007 |

OTHER PUBLICATIONS

International Search Report Dated Jan. 14, 2008—5 pgs.
'Enzymes in Detergency', edited by Jan H. van Ee; 1997; Chapter 10: 'Development of New Cellulases' by Karl-Heinz Maurer, pp. 175-202.
Helbert et al, "Fluorescent Cellulose Microfibrils as Substrate for the Detection of Cellulase Activity"; Biomacromolecules, 2003, 4, pp. 481-487.

* cited by examiner

*Primary Examiner* — Rebecca Prouty
(74) *Attorney, Agent, or Firm* — Melissa G Krasovec

(57) ABSTRACT

This invention relates to laundry detergent compositions comprising bacterial alkaline enzymes exhibiting endo-beta-1,4-glucanase activity (E.C. 3.2.1.4) and fabric hueing agents.

9 Claims, No Drawings

DETERGENT COMPOSITIONS

FIELD OF THE INVENTION

This invention relates to laundry detergent compositions comprising a bacterial alkaline enzyme exhibiting endo-beta-1,4-glucanase activity (E.C. 3.2.1.4) and a fabric hueing agent and processes for making and using such products.

BACKGROUND OF THE INVENTION

Cellulase enzymes have been used in detergent compositions for many years now for their known benefits of depilling, softness and colour care. However, the use of most of cellulases has been limited because of the negative impact that cellulase may have on the tensile strength of the fabrics' fibers by hydrolysing crystalline cellulose. Recently, cellulases with a high specificity towards amorphous cellulose have been developed to exploit the cleaning potential of cellulases while avoiding the negative tensile strength loss. Especially alkaline endo-glucanases have been developed to suit better the use in alkaline detergent conditions.

For example, Novozymes in WO02/099091 discloses a novel enzyme exhibiting endo-beta-glucanase activity (EC 3.2.1.4) endogenous to the strain *Bacillus* sp., DSM 12648; for use in detergent and textile applications. Novozymes further describes in WO04/053039 detergent compositions comprising an anti-redeposition endo-glucanase and its combination with certain cellulases having increased stability towards anionic surfactant and/or further specific enzymes. Kao's EP 265 832 describes novel alkaline cellulase K, CMCase I and CMCase II obtained by isolation from a culture product of *Bacillus* sp KSM-635. Kao further describes in EP 1 350 843, alkaline cellulase which acts favourably in an alkaline environment and can be mass produced readily because of having high secretion capacity or having enhanced specific activity.

We have found that the combination of alkaline bacterial endoglucanases and hueing agents deliver improved, synergistic whitening benefits. Without wishing to be bound by theory, it is believed that the following mechanisms are likely to give rise to such benefits: the endoglucanase enzyme hydrolyses amorphous cellulose present on the cotton surface, and thereby assists the removal of yellow soils and opens up the pore structure of the fabric making it more accessible to dye molecules. The resulting combination of improved yellow soil removal and improved shading colorant deposition leads to an improvement in fabric appearance. These combined effects hence contribute to a surprising improvement in visual perception and hence, in cleaning perception.

SUMMARY OF THE INVENTION

The present invention relates to compositions comprising a fabric hueing agent and a bacterial alkaline enzyme exhibiting endo-beta-1,4-glucanase activity (E.C. 3.2.1.4).

SEQUENCE LISTINGS

SEQ ID NO: 1 shows the amino acid sequence of an endoglucanase from *Bacillus* sp. AA349

SEQ ID NO: 2 shows the amino acid sequence of an endoglucanase from *Bacillus* sp KSM-S237

DETAILED DESCRIPTION OF THE INVENTION

Definitions

As used herein, the term "cleaning composition" includes, unless otherwise indicated, granular or powder-form all-purpose or "heavy-duty" washing agents, especially laundry detergents; liquid, gel or paste-form all-purpose washing agents, especially the so-called heavy-duty liquid types; liquid fine-fabric detergents; as well as cleaning auxiliaries such as bleach additives and "stain-stick" or pre-treat types.

As used herein the term 'fabric hueing agent' means dyes or pigments which when formulated in detergent compositions can deposit onto a fabric when said fabric is contacted with a wash liquor comprising said detergent compositions thus altering the tint of said fabric through absorption of visible light. For the purposes of the present application, fluorescent whitening agents, also called optical brighteners, are not considered fabric hueing agents, as they exert their effects on fabric through emission, rather than absorption, of visible light.

Compositions

The compositions of the present invention may contain from 0.00003% to 0.1%, from 0.00008% to 0.05%, or even from 0.0001% to 0.04% by weight of one or more fabric hueing agent and from 0.00005% to 0.15%, from 0.0002% to 0.02%, or even from 0.0005% to 0.01% by weight of pure enzyme, of one or more endoglucanase(s). The balance of any aspects of the aforementioned cleaning compositions is made up of one or more adjunct materials.

Suitable Endoglucanase

The endoglucanase to be incorporated into the detergent composition of the present invention is one or more bacterial alkaline enzyme(s) exhibiting endo-beta-1,4-glucanase activity (E.C. 3.2.1.4).

As used herein, the term "alkaline endoglucanase", shall mean an endoglucanase having an optimum pH above 7 and retaining greater than 70% of its optimal activity at pH10.

Preferably, the endoglucanase is a bacterial polypeptide endogenous to a member of the genus *Bacillus*.

More preferably, the alkaline enzyme exhibiting endo-beta-1,4-glucanase activity (E.C. 3.2.1.4), is a polypeptide containing (i) at least one family 17 carbohydrate binding module (Family 17 CBM) and/or (ii) at least one family 28 carbohydrate binding module (Family 28 CBM). Please refer for example to: Current Opinion in Structural Biology, 2001, 593-600 by Y. Bourne and B. Henrissat in their article entitled: "Glycoside hydrolases and glycosyltransferases: families and functional modules" for the definition and classification of CBMs. Please refer further to Biochemical Journal, 2002, v361, 35-40 by A. B. Boraston et al in their article entitled: "Identification and glucan-binding properties of a new carbohydrate-binding module family" for the properties of the family 17 and 28 CBM's.

In a more preferred embodiment, said enzyme comprises a polypeptide (or variant thereof) endogenous to one of the following *Bacillus* species:

| *Bacillus* sp. | As described in: |
|---|---|
| AA349 (DSM 12648) | WO 2002/099091A (Novozymes) p2, line 25 |
| | WO 2004/053039A (Novozymes) p3, line19 |
| KSM S237 | EP 1350843A (Kao) p3, line 18 |
| 1139 | EP 1350843A (Kao) p3, line 22 |
| KSM 64 | EP 1350843A (Kao) p3, line 24 |
| KSM N131 | EP 1350843A (Kao) p3, line 25 |
| KSM 635, FERM BP 1485 | EP 265 832A (Kao) p7, line 45 |
| KSM 534, FERM BP 1508 | EP 0271044 A (Kao) p9, line 21 |

-continued

| *Bacillus* sp. | As described in: |
|---|---|
| KSM 539, FERM BP 1509 | EP 0271044 A (Kao) p9, line 22 |
| KSM 577, FERM BP 1510 | EP 0271044 A (Kao) p9, line 22 |
| KSM 521, FERM BP 1507 | EP 0271044 A (Kao) p9, line 19 |
| KSM 580, FERM BP 1511 | EP 0271044 A (Kao) p9, line 20 |
| KSM 588, FERM BP 1513 | EP 0271044 A (Kao) p9, line 23 |
| KSM 597, FERM BP 1514 | EP 0271044 A (Kao) p9, line 24 |
| KSM 522, FERM BP 1512 | EP 0271044 A (Kao) p9, line 20 |
| KSM 3445, FERM BP 1506 | EP 0271044 A (Kao) p10, line 3 |
| KSM 425. FERM BP 1505 | EP 0271044 A (Kao) p10, line 3 |

Suitable endoglucanases for the compositions of the present invention are:

1) An enzyme exhibiting endo-beta-1,4-glucanase activity (E.C. 3.2.1.4), which has a sequence of at least 90%, preferably 94%, more preferably 97% and even more preferably 99%, 100% identity to the amino acid sequence of position 1 to position 773 of SEQ ID NO:1 (Corresponding to SEQ ID NO:2 in WO02/099091); or a fragment thereof that has endo-beta-1,4-glucanase activity, when identity is determined by GAP provided in the GCG program using a GAP creation penalty of 3.0 and GAP extension penalty of 0.1. The enzyme and the corresponding method of production is described extensively in patent application WO02/099091 published by Novozymes A/S on Dec. 12, 2002. Please refer to the detailed description pages 4 to 17 and to the examples page 20 to page 26. One of such enzyme is commercially available under the tradename Celluclean™ by Novozymes A/S.

GCG refers to the sequence analysis software package provided by Accelrys, San Diego, Calif., USA. This incorporates a program called GAP which uses the algorithm of Needleman and Wunsch to find the alignment of two complete sequences that maximises the number of matches and minimises the number of gaps.

2) Also suitable are the alkaline endoglucanase enzymes described in EP 1 350 843A published by Kao corporation on Oct. 8, 2003. Please refer to the detailed description [0011] to [0039] and examples 1 to 4 [0067] to [0077] for a detailed description of the enzymes and its production. The alkaline cellulase variants are obtained by substituting the amino acid residue of a cellulase having an amino acid sequence exhibiting at least 90%, preferably 95%, more preferably 98% and even 100% identity with the amino acid sequence represented by SEQ. ID NO:2 (Corresponding to SEQ. ID NO:1 in EP 1 350 843 on pages 11-13) at (a) position 10, (b) position 16, (c) position 22, (d) position 33, (e) position 39, (f) position 76, (g) position 109, (h) position 242, (i) position 263, (j) position 308, (k) position 462, (l) position 466, (m) position 468, (n) position 552, (o) position 564, or (p) position 608 in SEQ ID NO:2 or at a position corresponding thereto with another amino acid residue Examples of the "alkaline cellulase having the amino acid sequence represented by SEQ. ID NO:2" include Eg1-237 [derived from *Bacillus* sp. strain KSM-S237 (FERM BP-7875), Hakamada, et al., Biosci. Biotechnol. Biochem., 64, 2281-2289, 2000]. Examples of the "alkaline cellulase having an amino acid sequence exhibiting at least 90% homology with the amino acid sequence represented by SEQ. ID NO:2" include alkaline cellulases having an amino acid sequence exhibiting preferably at least 95% homology, more preferably at least 98% homology, with the amino acid sequence represented by SEQ. ID NO:2. Specific examples include alkaline cellulase derived from *Bacillus* sp. strain 1139 (Eg1-1139) (Fukumori, et al., J. Gen. Microbiol., 132, 2329-2335) (91.4% homology), alkaline cellulases derived from *Bacillus* sp. strain KSM-64 (Eg1-64) (Sumitomo, et al., Biosci. Biotechnol. Biochem., 56, 872-877, 1992) (homology: 91.9%), and cellulase derived from *Bacillus* sp. strain KSM-N131 (Eg1-N131b) (Japanese Patent Application No. 2000-47237) (homology: 95.0%).

The amino acid is preferably substituted by: glutamine, alanine, proline or methionine, especially glutamine is preferred at position (a), asparagine or arginine, especially asparagine is preferred at position (b), proline is preferred at position (c), histidine is preferred at position (d), alanine, threonine or tyrosine, especially alanine is preferred at position (e), histidine, methionine, valine, threonine or alanine, especially histidine is preferred at position (f), isoleucine, leucine, serine or valine, especially isoleucine is preferred at position (g), alanine, phenylalanine, valine, serine, aspartic acid, glutamic acid, leucine, isoleucine, tyrosine, threonine, methionine or glycine, especially alanine, phenylalanine or serine is preferred at position (h), isoleucine, leucine, proline or valine, especially isoleucine is preferred at position (i), alanine, serine, glycine or valine, especially alanine is preferred at position (j), threonine, leucine, phenylalanine or arginine, especially threonine is preferred at position (k), leucine, alanine or serine, especially leucine is preferred at position (l), alanine, aspartic acid, glycine or lysine, especially alanine is preferred at position (m), methionine is preferred at position (n), valine, threonine or leucine, especially valine is preferred at position (o) and isoleucine or arginine, especially isoleucine is preferred at position (p).

The "amino acid residue at a position corresponding thereto" can be identified by comparing amino acid sequences by using known algorithm, for example, that of Lipman-Pearson's method, and giving a maximum similarity score to the multiple regions of simirality in the amino acid sequence of each alkaline cellulase. The position of the homologous amino acid residue in the sequence of each cellulase can be determined, irrespective of insertion or depletion existing in the amino acid sequence, by aligning the amino acid sequence of the cellulase in such manner (FIG. 1 of EP 1 350 843). It is presumed that the homologous position exists at the three-dimensionally same position and it brings about similar effects with regard to a specific function of the target cellulase.

With regard to another alkaline cellulase having an amino acid sequence exhibiting at least 90% homology with SEQ. ID NO:2, specific examples of the positions corresponding to (a) position 10, (b), position 16, (c) position 22, (d) position 33, (e) position 39, (f) position 76, (g) position 109, (h) position 242, (i) position 263, (j) position 308, (k) position 462, (l) position 466, (m) position 468, (n) position 552, (o) position 564 and (p) position 608 of the alkaline cellulase (Eg1-237) represented by SEQ. ID NO: 2 and amino acid residues at these positions will be shown below:

| | Egl-237 | Egl-1139 | Egl-64 | Egl-N131b |
|---|---|---|---|---|
| (a) | 10Leu | 10Leu | 10Leu | 10Leu |
| (b) | 16Ile | 16Ile | 16Ile | Nothing corresponding thereto |
| (c) | 22Ser | 22Ser | 22Ser | Nothing corresponding thereto |
| (d) | 33Asn | 33Asn | 33Asn | 19Asn |
| (e) | 39Phe | 39Phe | 39Phe | 25Phe |
| (f) | 76Ile | 76Ile | 76Ile | 62Ile |
| (g) | 109Met | 109Met | 109Met | 95Met |
| (h) | 242Gln | 242Gln | 242Gln | 228Gln |
| (i) | 263Phe | 263Phe | 263Phe | 249Phe |
| (j) | 308Thr | 308Thr | 308Thr | 294Thr |
| (k) | 462Asn | 461Asn | 461Asn | 448Asn |

-continued

| | Egl-237 | Egl-1139 | Egl-64 | Egl-N131b |
|---|---|---|---|---|
| (l) | 466Lys | 465Lys | 465Lys | 452Lys |
| (m) | 468Val | 467Val | 467Val | 454Val |
| (n) | 552Ile | 550Ile | 550Ile | 538Ile |
| (o) | 564Ile | 562Ile | 562Ile | 550Ile |
| (p) | 608Ser | 606Ser | 606Ser | 594Ser |

3) Also suitable is the alkaline cellulase K described in EP 265 832A published by Kao on May 4, 1988. Please refer to the description page 4, line 35 to page 12, line 22 and examples 1 and 2 on page 19 for a detailed description of the enzyme and its production. The alkaline cellulase K has the following physical and chemical properties:

(1) Activity: Having a Cx enzymatic activity of acting on carboxymethyl cellulose along with a weak $C_1$ enzymatic activity and a weak beta-glucoxidase activity;

(2) Specificity on Substrates: Acting on carboxymethyl cellulose(CMC), crystalline cellulose, Avicell, cellobiose, and p-nitrophenyl cellobioside(PNPC);

(3) Having a working pH in the range of 4 to 12 and an optimum pH in the range of 9 to 10;

(4) Having stable pH values of 4.5 to 10.5 and 6.8 to 10 when allowed to stand at 40° C. for 10 minutes and 30 minutes, respectively;

(5) Working in a wide temperature range of from 10 to 65° C. with an optimum temperature being recognized at about 40° C.;

(6) Influences of chelating agents: The activity not impeded with ethylenediamine tetraacetic acid (EDTA), ethyleneglycol-bis-(β-aminoethylether) N,N,N',N"-tetraacetic acid (EGTA), N,N-bis(carboxymethyl)glycine (nitrilotriacetic acid) (NTA), sodium tripolyphosphate (STPP) and zeolite;

(7) Influences of surface active agents: Undergoing little inhibition of activity by means of surface active agents such as sodium linear alkylbenzenesulfonates (LAS), sodium alkylsulfates (AS), sodium polyoxyethylene alkylsulfates (ES), sodium alpha-olefinsulfonates (AOS), sodium alpha-sulfonated aliphatic acid esters (alpha-SFE), sodium alkylsulfonates (SAS), polyoxyethylene secondary alkyl ethers, fatty acid salts (sodium salts), and dimethyldialkylammonium chloride;

(8) Having a strong resistance to proteinases; and (9) Molecular weight (determined by gel chromatography): Having a maximum peak at 180,000±10,000.

Preferably such enzyme is obtained by isolation from a culture product of *Bacillus* sp KSM-635.

Cellulase K is commercially available by the Kao Corporation: e.g. the cellulase preparation Eg-X known as KAC® being a mixture of E-H and E-L both from *Bacillus* sp. KSM-635 bacterium. Cellulases E-H and E-L have been described in S. Ito, Extremophiles, 1997, v1, 61-66 and in S. Ito et al, Agric Biol Chem, 1989, v53, 1275-1278.

4) The alkaline bacterial endoglucanases described in EP 271 004A published by Kao on Jun. 15, 1988 are also suitable for the purpose of the present invention. Please refer to the description page 9, line 15 to page 23, line 17 and page 31, line 1 to page 33, line 17 for a detailed description of the enzymes and its production. Those are:

Alkaline Cellulase K-534 from KSM 534, FERM BP 1508,
Alkaline Cellulase K-539 from KSM 539, FERM BP 1509,
Alkaline Cellulase K-577 from KSM 577, FERM BP 1510,
Alkaline Cellulase K-521 from KSM 521, FERM BP 1507,
Alkaline Cellulase K-580 from KSM 580, FERM BP 1511,
Alkaline Cellulase K-588 from KSM 588, FERM BP 1513,
Alkaline Cellulase K-597 from KSM 597, FERM BP 1514,
Alkaline Cellulase K-522 from KSM 522, FERM BP 1512,
Alkaline Cellulase E-II from KSM 522, FERM BP 1512,
Alkaline Cellulase E-III from KSM 522, FERM BP 1512.
Alkaline Cellulase K-344 from KSM 344; FERM BP 1506, and
Alkaline Cellulase K-425 from KSM 425, FERM BP 1505.

5) Finally, the alkaline endoglucanases derived from *Bacillus* species KSM-N described in JP2005287441A, published by Kao on the Oct. 20, 2005, are also suitable for the purpose of the present invention. Please refer to the description page 4, line 39 to page 10, line 14 for a detailed description of the enzymes and its production. Examples of such alkaline endoglucanases are:

Alkaline Cellulase Eg1-546H from *Bacillus* sp. KSM-N546
Alkaline Cellulase Eg1-115 from *Bacillus* sp. KSM-N115
Alkaline Cellulase Eg1-145 from *Bacillus* sp. KSM-N145
Alkaline Cellulase Eg1-659 from *Bacillus* sp. KSM-N659
Alkaline Cellulase Eg1-640 from *Bacillus* sp. KSM-N440

Also encompassed in the present invention are variants of the above described enzymes obtained by various techniques known by persons skilled in the art such as directed evolution.

Fabric Hueing Agents

Fluorescent whitening agents emit at least some visible light. In contrast, fabric hueing agents can alter the tint of a surface as they absorb at least a portion of the visible light spectrum. Suitable fabric hueing agents include dyes and dye-clay conjugates, and may also include pigments. In one aspect, suitable fabric hueing agents include those fabric hueing agents that satisfy the requirements of Test Method 1 in the Test Method Section of the present specification. Suitable dyes include small molecule dyes and polymeric dyes.

Suitable small molecule dyes include small molecule dyes selected from the group consisting of dyes falling into the Colour Index (C.I.) classifications of Direct Blue, Direct Red, Direct Violet, Acid Blue, Acid Red, Acid Violet, Basic Blue, Basic Violet and Basic Red, or mixtures thereof, for example:

(1) Tris-Azo Direct Blue Dyes of the Formula

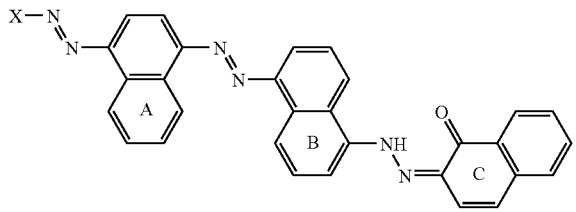

where at least two of the A, B and C napthyl rings are substituted by a sulfonate group, the C ring may be substituted at the 5 position by an $NH_2$ or NHPh group, X is a benzyl or naphthyl ring substituted with up to 2 sulfonate groups and may be substituted at the 2 position with an OH group and may also be substituted with an $NH_2$ or NHPh group.

(2) Bis-Azo Direct Violet Dyes of the Formula:

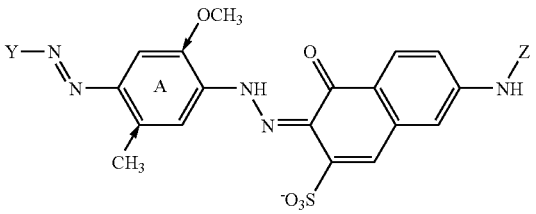

where Z is H or phenyl, the A ring is preferably substituted by a methyl and methoxy group at the positions indicated by arrows, the A ring may also be a naphthyl ring, the Y group is a benzyl or naphthyl ring, which is substituted by sulfate group and may be mono or disubstituted by methyl groups.

(3) Blue or Red Acid Dyes of the Formula

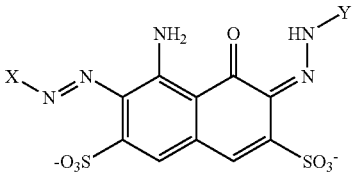

where at least one of X and Y must be an aromatic group. In one aspect, both the aromatic groups may be a substituted benzyl or naphthyl group, which may be substituted with non water-solubilising groups such as alkyl or alkyloxy or aryloxy groups, X and Y may not be substituted with water solubilising groups such as sulfonates or carboxylates. In another aspect, X is a nitro substituted benzyl group and Y is a benzyl group (4) Red Acid Dyes of the Structure

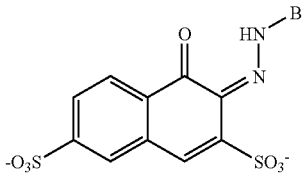

or

-continued

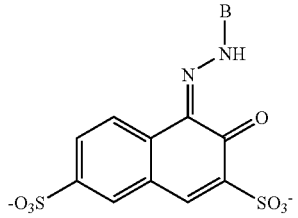

where B is a naphthyl or benzyl group that may be substituted with non water solubilising groups such as alkyl or alkyloxy or aryloxy groups, B may not be substituted with water solubilising groups such as sulfonates or carboxylates.

(5) Dis-Azo Dyes of the Structure

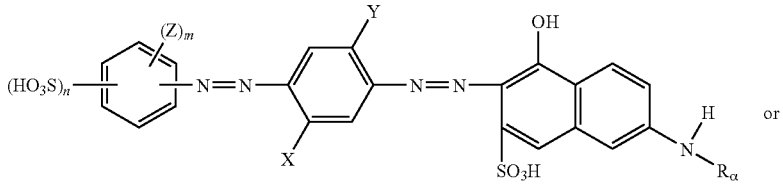

or

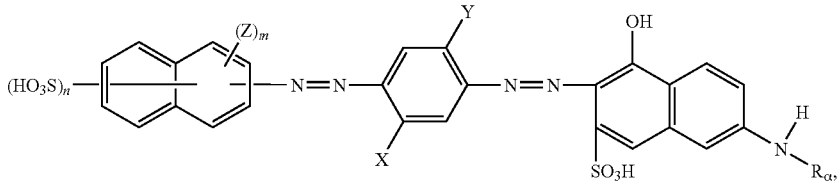

wherein X and Y, independently of one another, are each hydrogen, $C_1$-$C_4$ alkyl or $C_1$-$C_4$-alkoxy, Rα is hydrogen or aryl, Z is $C_1$-$C_4$ alkyl; $C_1$-$C_4$-alkoxy; halogen; hydroxyl or carboxyl, n is 1 or 2 and m is 0, 1 or 2, as well as corresponding salts thereof and mixtures thereof (6) Triphenylmethane Dyes of the Following Structures

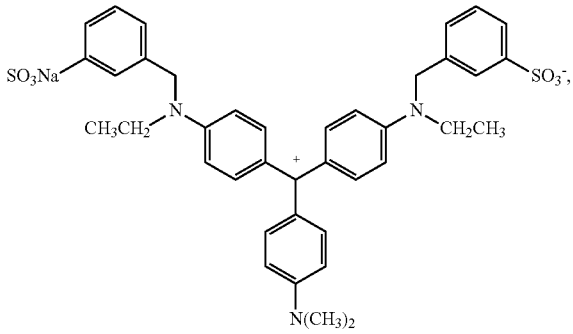

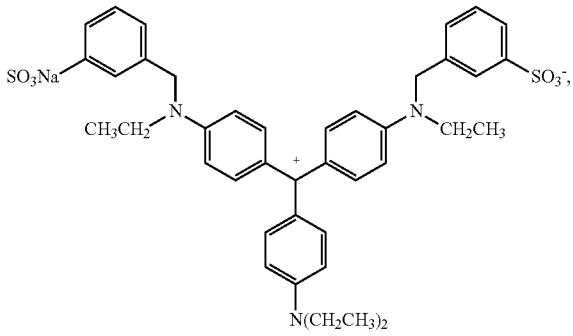

-continued

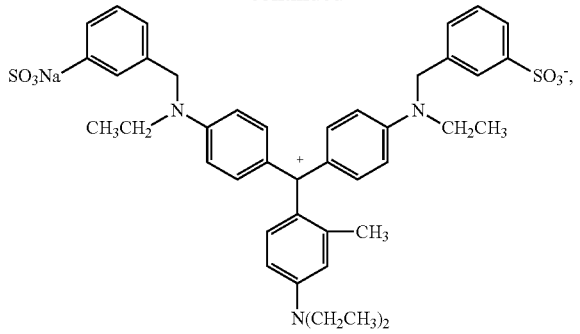

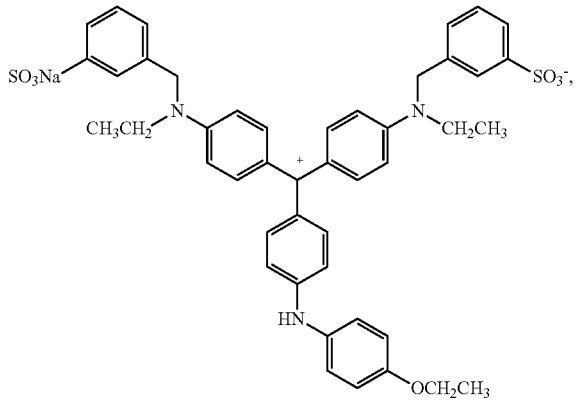

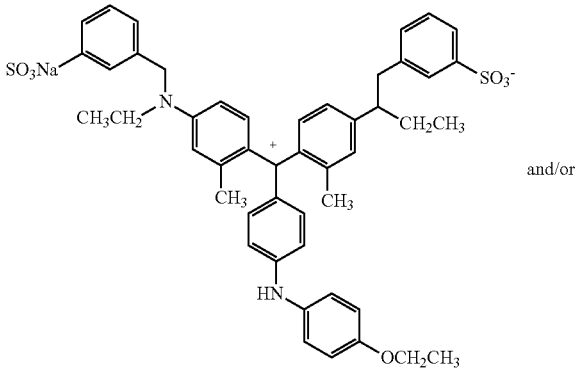

and/or

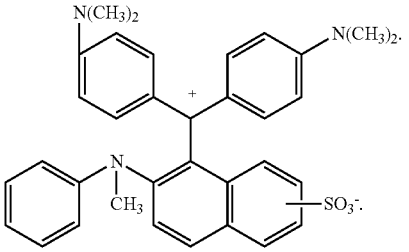

and mixtures thereof.

In another aspect, suitable small molecule dyes include small molecule dyes selected from the group consisting of Colour Index (Society of Dyers and Colourists, Bradford, UK) numbers Direct Violet 9, Direct Violet 35, Direct Violet 48, Direct Violet 51, Direct Violet 66, Direct Blue 1, Direct Blue 71, Direct Blue 80, Direct Blue 279, Acid Red 17, Acid Red 73, Acid Red 88, Acid Red 150, Acid Violet 15, Acid Violet 17, Acid Violet 24, Acid Violet 43, Acid Violet 49, Acid Blue 15, Acid Blue 17, Acid Blue 25, Acid Blue 29, Acid Blue 40, Acid Blue 45, Acid Blue 75, Acid Blue 80, Acid Blue 83, Acid Blue 90 and Acid Blue 113, Acid Black 1, Basic Violet 1, Basic Violet 3, Basic Violet 4, Basic Violet 10, Basic Violet 35, Basic Blue 3, Basic Blue 16, Basic Blue 22, Basic Blue 47, Basic Blue 66, Basic Blue 75, Basic Blue 159 and mixtures thereof. In another aspect, suitable small molecule dyes include small molecule dyes selected from the group consisting of Colour Index (Society of Dyers and Colourists, Bradford, UK) numbers Acid Violet 17, Acid Violet 43, Acid Red 73, Acid Red 88, Acid Red 150, Acid Blue 25, Acid Blue 29, Acid Blue 45, Acid Blue 113, Acid Black 1, Direct Blue 1, Direct Blue 71, Direct Violet 51 and mixtures thereof.

In another aspect, suitable small molecule dyes include small molecule dyes selected from the group consisting of Colour Index (Society of Dyers and Colourists, Bradford, UK) numbers Acid Violet 17, Direct Blue 71, Direct Violet 51, Direct Blue 1, Acid Red 88, Acid Red 150, Acid Blue 29, Acid Blue 113 or mixtures thereof.

In another aspect, suitable small molecule dyes include photobleaches which satisfy the requirements of Test Method 1 in the Test Method Section. Such materials function as both fabric hueing dyes and also as photobleaching agents, i.e. they generate bleaching species on exposure to light. Suitable photobleaches include catalytic photobleaches selected from the group consisting of water soluble phthalocyanines of the formula:

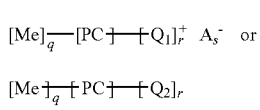

(1a)

(1b)

in which:

PC is the phthalocyanine ring system;

Me is Zn; Fe(II); Ca; Mg; Na; K; Al—$Z_1$; Si(IV); P(V); Ti(IV); Ge(IV); Cr(VI); Ga(III); Zr(IV); In(III); Sn(IV) or Hf(VI);

$Z_1$ is a halide; sulfate; nitrate; carboxylate; alkanolate; or hydroxyl ion;

q is 0; 1 or 2;

r is 1 to 4;

$Q_1$, is a sulfo or carboxyl group; or a radical of the formula —$SO_2X_2$—$R_1$—$X_3^+$; —O—$R_1$—$X_3^+$; or —$(CH_2)_t$—$Y_1^+$;

in which $R_1$ is a branched or unbranched $C_1$-$C_8$ alkylene; or 1,3- or 1,4-phenylene;

$X_2$ is —NH—; or —N—$C_1$-$C_5$ alkyl;

$X_3^+$ is a group of the formula

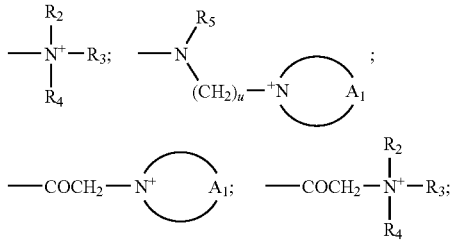

or, in the case where $R_1$=$C_1$-$C_8$alkylene, also a group of the formula

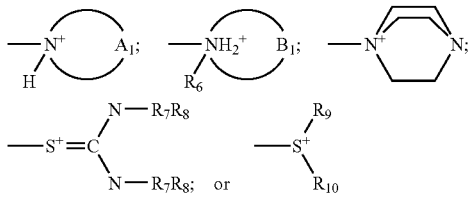

$Y_1^+$ is a group of the formula

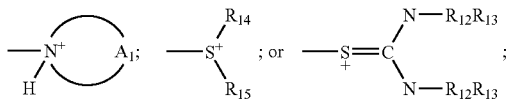

t is 0 or 1 where in the above formulae $R_2$ and $R_3$ independently of one another are $C_1$-$C_6$ alkyl $R_4$ is $C_1$-$C_5$ alkyl; $C_5$-$C_7$ cycloalkyl or $NR_7R_8$;

$R_5$ and $R_6$ independently of one another are $C_1$-$C_5$ alkyl;

$R_7$ and $R_8$ independently of one another are hydrogen or $C_1$-$C_5$ alkyl;

$R_9$ and $R_{10}$ independently of one another are unsubstituted $C_1$-$C_6$ alkyl or $C_1$-$C_6$ alkyl substituted by hydroxyl, cyano, carboxyl, carb-$C_1$-$C_6$ alkoxy, $C_1$-$C_6$ alkoxy, phenyl, naphthyl or pyridyl;

u is from 1 to 6;

$A_1$ is a unit which completes an aromatic 5- to 7-membered nitrogen heterocycle, which may where appropriate also contain one or two further nitrogen atoms as ring members, and $B_1$ is a unit which completes a saturated 5- to 7-membered nitrogen heterocycle, which may where appropriate also contain 1 to 2 nitrogen, oxygen and/or sulfur atoms as ring members;

$Q_2$ is hydroxyl; $C_1$-$C_{22}$ alkyl; branched $C_3$-$C_{22}$ alkyl; $C_2$-$C_{22}$ alkenyl; branched $C_3$-$C_{22}$ alkenyl and mixtures thereof; $C_1$-$C_{22}$ alkoxy; a sulfo or carboxyl radical; a radical of the formula

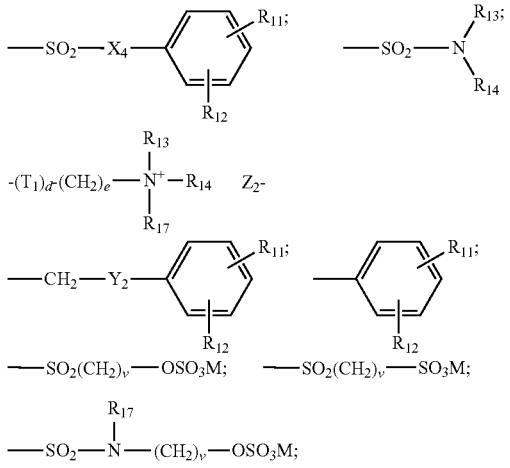

-continued

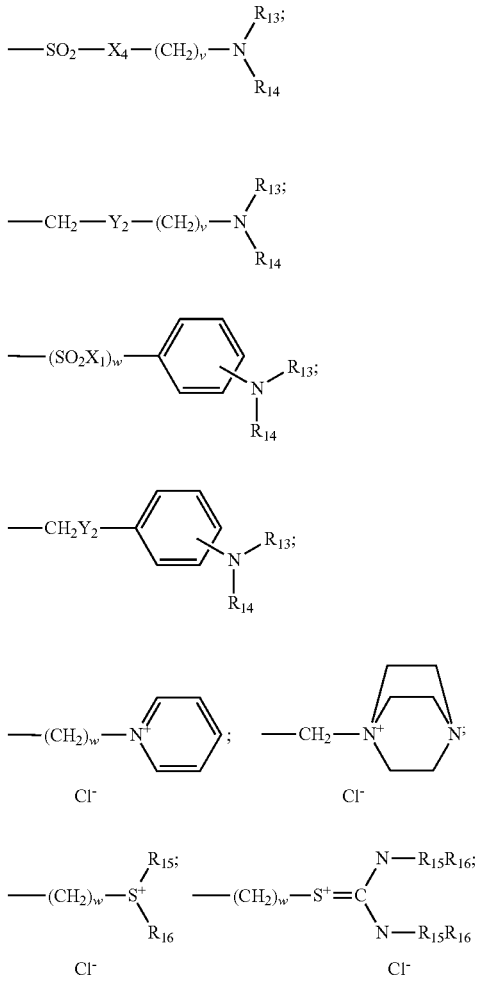

a branched alkoxy radical of the formula

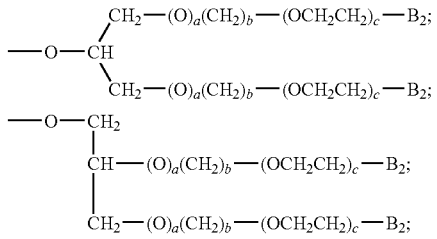

an alkylethyleneoxy unit of the formula $$-(T_1)_d-(CH_2)_b(OCH_2CH_2)_a—B_3$$

or an ester of the formula $$COOR_{18}$$

in which $B_2$ is hydrogen; hydroxyl; $C_1$-$C_{30}$ alkyl; $C_1$-$C_{30}$ alkoxy; —$CO_2H$; —$CH_2COOH$; —$SO_3$-$M_1$; —$OSO_3$-$M_1$; —$PO_3^{2-}M_1$; —$OPO_3^{2-}M_1$; and mixtures thereof;

$B_3$ is hydrogen; hydroxyl; —COON; —$SO_3$-$M_1$; —$OSO_3$ $M_1$ or $C_1$-$C_6$ alkoxy;

$M_1$ is a water-soluble cation;

$T_1$ is —O—; or —NH—;

$X_1$ and $X_4$ independently of one another are —O—; —NH— or —N—$C_1$-$C_5$alkyl;

$R_{11}$ and $R_{12}$ independently of one another are hydrogen; a sulfo group and salts thereof; a carboxyl group and salts thereof or a hydroxyl group; at least one of the radicals $R_{11}$ and $R_{12}$ being a sulfo or carboxyl group or salts thereof, $Y_2$ is —O—; —S—; —NH— or —N—$C_1$-$C_5$alkyl;

$R_{13}$ and $R_{14}$ independently of one another are hydrogen; $C_1$-$C_6$ alkyl; hydroxy-$C_1$-$C_6$ alkyl; cyano-$C_1$-$C_6$ alkyl; sulfo-$C_1$-$C_6$ alkyl; carboxy or halogen-$C_1$-$C_6$ alkyl; unsubstituted phenyl or phenyl substituted by halogen, $C_1$-$C_4$ alkyl or $C_1$-$C_4$ alkoxy; sulfo or carboxyl or $R_{13}$ and $R_{14}$ together with the nitrogen atom to which they are bonded form a saturated 5- or 6-membered heterocyclic ring which may additionally also contain a nitrogen or oxygen atom as a ring member;

$R_{15}$ and $R_{16}$ independently of one another are $C_1$-$C_6$ alkyl or aryl-$C_1$-$C_6$ alkyl radicals;

$R_{17}$ is hydrogen; an unsubstituted $C_1$-$C_6$ alkyl or $C_1$-$C_6$ alkyl substituted by halogen, hydroxyl, cyano, phenyl, carboxyl, carb-$C_1$-$C_6$ alkoxy or $C_1$-$C_6$ alkoxy;

$R_{18}$ is $C_1$-$C_{22}$ alkyl; branched $C_3$-$C_{22}$ alkyl; $C_1$-$C_{22}$ alkenyl or branched $C_3$-$C_{22}$ alkenyl; $C_3$-$C_{22}$ glycol; $C_1$-$C_{22}$ alkoxy; branched $C_3$-$C_{22}$ alkoxy; and mixtures thereof;

M is hydrogen; or an alkali metal ion or ammonium ion, $Z_2^-$ is a chlorine; bromine; alkylsulfate or arylsulfate ion;

a is 0 or 1;

b is from 0 to 6;

c is from 0 to 100;

d is 0; or 1;

e is from 0 to 22;

v is an integer from 2 to 12;

w is 0 or 1; and $A^-$ is an organic or inorganic anion, and s is equal to r in cases of monovalent anions $A^-$ and less than or equal to r in cases of polyvalent anions, it being necessary for $A_s^-$ to compensate the positive charge; where, when r is not equal to 1, the radicals $Q_1$ can be identical or different, and where the phthalocyanine ring system may also comprise further solubilising groups;

Other suitable catalytic photobleaches include (i) xanthene dyes and mixtures thereof; and (ii) those selected from the group consisting of sulfonated zinc phthalocyanine, sulfonated aluminium phthalocyanine, Eosin Y, Phoxine B, Rose Bengal, C.I. Food Red 14 and mixtures thereof.

In another embodiment, fabric hueing dyes include photobleach-dye conjugates. Such materials contain at least one chromogen and at least one photobleach moiety in the same molecule. These include materials comprising at least one Zn—, Ca—, Mg—, Na—, K—, Al—, Si—, Ti—, Ge—, Ga—, Zr—, In— or Sn-phthalocyanine to which at least one dyestuff is attached through a covalent bonding. Examples of suitable materials are given below.

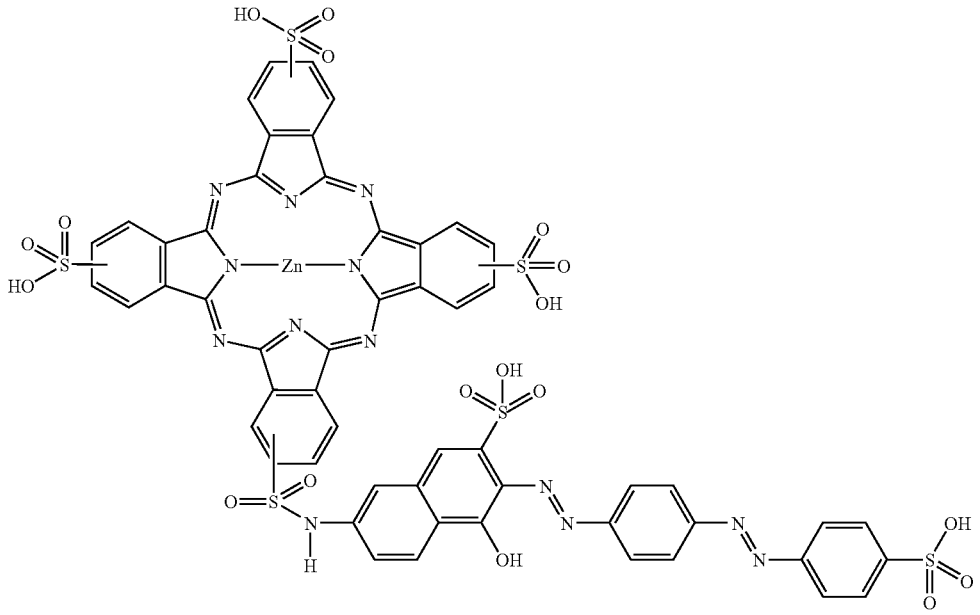

-continued

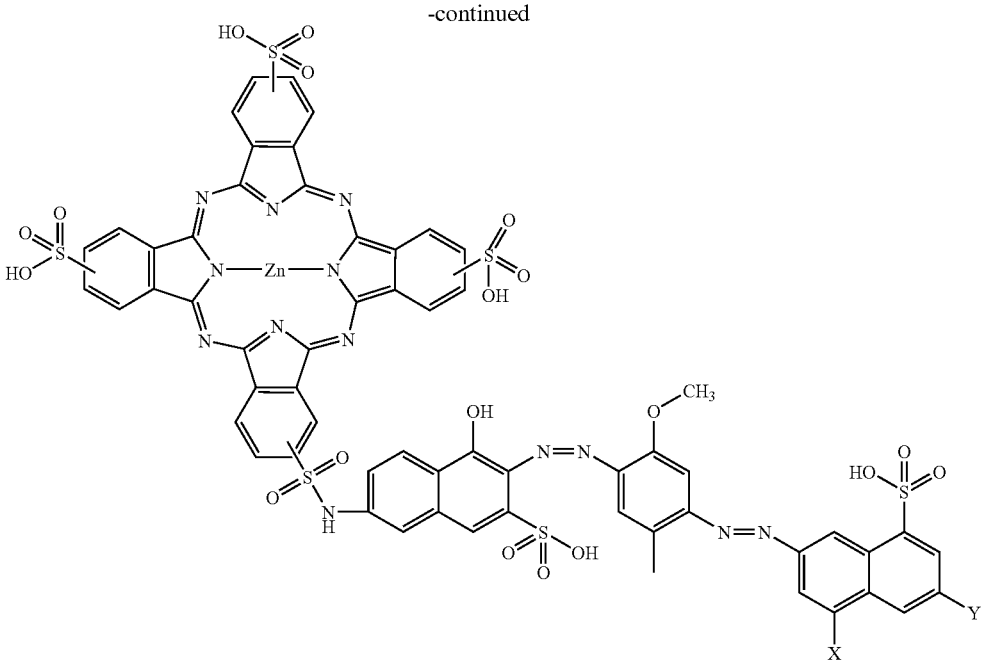

x = H, y = $SO_3H$
x = $SO_3H$, y = H

Suitable polymeric dyes include polymeric dyes selected from the group consisting of polymers containing conjugated chromogens (dye-polymer conjugates) and polymers with chromogens co-polymerised into the backbone of the polymer and mixtures thereof.

In another aspect, suitable polymeric dyes include polymeric dyes selected from the group consisting of fabric-substantive colorants sold under the name of Liquitint® (Milliken, Spartanburg, S.C., USA), dye-polymer conjugates formed from at least one reactive dye and a polymer selected from the group consisting of polymers comprising a moiety selected from the group consisting of a hydroxyl moiety, a primary amine moiety, a secondary amine moiety, a thiol moiety and mixtures thereof. In still another aspect, suitable polymeric dyes include polymeric dyes selected from the group consisting of Liquitint® (Milliken, Spartanburg, S.C., USA) Violet Conn., carboxymethyl cellulose (CMC) conjugated with a reactive blue, reactive violet or reactive red dye such as CMC conjugated with C.I. Reactive Blue 19, sold by Megazyme, Wicklow, Ireland under the product name AZO-CM-CELLULOSE, product code S-ACMC and mixtures thereof.

Suitable dye clay conjugates include dye clay conjugates selected from the group comprising at least one cationic/basic dye and a smectite clay, and mixtures thereof. In another aspect, suitable dye clay conjugates include dye clay conjugates selected from the group consisting of one cationic/basic dye selected from the group consisting of C.I. Basic Yellow 1 through 108, C.I. Basic Orange 1 through 69, C.I. Basic Red 1 through 118, C.I. Basic Violet 1 through 51, C.I. Basic Blue 1 through 164, C.I. Basic Green 1 through 14, C.I. Basic Brown 1 through 23, CI Basic Black 1 through 11, and a clay selected from the group consisting of Montmorillonite clay, Hectorite clay, Saponite clay and mixtures thereof. In still another aspect, suitable dye clay conjugates include dye clay conjugates selected from the group consisting of Montmorillonite Basic Blue B7 C.I. 42595 conjugate, Montmorillonite Basic Blue B9 C.I. 52015 conjugate, Montmorillonite Basic Violet V3 C.I. 42555 conjugate, Montmorillonite Basic Green G1 C.I. 42040 conjugate, Montmorillonite Basic Red R1 C.I. 45160 conjugate, Montmorillonite C.I. Basic Black 2 conjugate, Hectorite Basic Blue B7 C.I. 42595 conjugate, Hectorite Basic Blue B9 C.I. 52015 conjugate, Hectorite Basic Violet V3 C.I. 42555 conjugate, Hectorite Basic Green G1 C.I. 42040 conjugate, Hectorite Basic Red R1 C.I. 45160 conjugate, Hectorite C.I. Basic Black 2 conjugate, Saponite Basic Blue B7 C.I. 42595 conjugate, Saponite Basic Blue B9 C.I. 52015 conjugate, Saponite Basic Violet V3 C.I. 42555 conjugate, Saponite Basic Green G1 C.I. 42040 conjugate, Saponite Basic Red R1 C.I. 45160 conjugate, Saponite C.I. Basic Black 2 conjugate and mixtures thereof.

Suitable pigments include pigments selected from the group consisting of flavanthrone, indanthrone, chlorinated indanthrone containing from 1 to 4 chlorine atoms, pyranthrone, dichloropyranthrone, monobromodichloropyranthrone, dibromodichloropyranthrone, tetrabromopyranthrone, perylene-3,4,9,10-tetracarboxylic acid diimide, wherein the imide groups may be unsubstituted or substituted by C1-C3-alkyl or a phenyl or heterocyclic radical, and wherein the phenyl and heterocyclic radicals may additionally carry substituents which do not confer solubility in water, anthrapyrimidinecarboxylic acid amides, violanthrone, isoviolanthrone, dioxazine pigments, copper phthalocyanine which may contain up to 2 chlorine atoms per molecule, polychloro-copper phthalocyanine or polybromochloro-copper phthalocyanine containing up to 14 bromine atoms per molecule and mixtures thereof.

In another aspect, suitable pigments include pigments selected from the group consisting of Ultramarine Blue (C.I. Pigment Blue 29), Ultramarine Violet (C.I. Pigment Violet 15) and mixtures thereof. In one aspect, Applicant's invention does not include Ultramarine Blue.

The aforementioned fabric hueing agents can be used in combination (any mixture of fabric hueing agents can be used). Suitable fabric hueing agents can be purchased from Aldrich, Milwaukee, Wis., USA; Ciba Specialty Chemicals, Basel, Switzerland; BASF, Ludwigshafen, Germany; Dayglo Color Corporation, Mumbai, India; Organic Dyestuffs Corp., East Providence, R.I., USA; Dystar, Frankfurt, Germany; Lanxess, Leverkusen, Germany; Megazyme, Wicklow, Ireland; Clariant, Muttenz, Switzerland; Avecia, Manchester, UK and/or made in accordance with the examples contained herein.

Adjunct Materials

While not essential for the purposes of the present invention, the non-limiting list of adjuncts illustrated hereinafter are suitable for use in the instant compositions and may be desirably incorporated in certain embodiments of the invention, for example to assist or enhance cleaning performance, for treatment of the substrate to be cleaned, or to modify the aesthetics of the cleaning composition as is the case with perfumes, colorants, dyes or the like. The precise nature of these additional components, and levels of incorporation thereof, will depend on the physical form of the composition and the nature of the cleaning operation for which it is to be used. Suitable adjunct materials include, but are not limited to, surfactants, builders, chelating agents, dye transfer inhibiting agents, dispersants, additional enzymes, and enzyme stabilizers, catalytic materials, bleach activators, hydrogen peroxide, sources of hydrogen peroxide, preformed peracids, polymeric dispersing agents, clay soil removal/anti-redeposition agents, brighteners, suds suppressors, dyes, perfumes, structure elasticizing agents, fabric softeners, carriers, hydrotropes, processing aids, solvents and/or pigments. In addition to the disclosure below, suitable examples of such other adjuncts and levels of use are found in U.S. Pat. Nos. 5,576,282, 6,306,812 B1 and U.S. Pat No. 6,326,348 B1 that are incorporated by reference. When one or more adjuncts are present, such one or more adjuncts may be present as detailed below:

Bleaching Agents—The cleaning compositions of the present invention may comprise one or more bleaching agents. Suitable bleaching agents other than bleaching catalysts include other photobleaches, bleach activators, hydrogen peroxide, sources of hydrogen peroxide, pre-formed peracids and mixtures thereof. In general, when a bleaching agent is used, the compositions of the present invention may comprise from about 0.1% to about 50% or even from about 0.1% to about 25% bleaching agent by weight of the subject cleaning composition. Examples of suitable bleaching agents include:

(1) other photobleaches for example Vitamin K3;

(2) preformed peracids: Suitable prefomied peracids include, but are not limited to, compounds selected from the group consisting of percarboxylic acids and salts, percarbonic acids and salts, perimidic acids and salts, peroxymonosulfuric acids and salts, for example, Oxone®, and mixtures thereof. Suitable percarboxylic acids include hydrophobic and hydrophilic peracids having the formula R—(C═O)O—O-M wherein R is an alkyl group, optionally branched, having, when the peracid is hydrophobic, from 6 to 14 carbon atoms, or from 8 to 12 carbon atoms and, when the peracid is hydrophilic, less than 6 carbon atoms or even less than 4 carbon atoms; and M is a counterion, for example, sodium, potassium or hydrogen;

(3) sources of hydrogen peroxide, for example, inorganic perhydrate salts, including alkali metal salts such as sodium salts of perborate (usually mono- or tetra-hydrate), percarbonate, persulphate, perphosphate, persilicate salts and mixtures thereof In one aspect of the invention the inorganic perhydrate salts are selected from the group consisting of sodium salts of perborate, percarbonate and mixtures thereof. When employed, inorganic perhydrate salts are typically present in amounts of from 0.05 to 40 wt %, or 1 to 30 wt % of the overall composition and are typically incorporated into such compositions as a crystalline solid that may be coated. Suitable coatings include, inorganic salts such as alkali metal silicate, carbonate or borate salts or mixtures thereof, or organic materials such as water-soluble or dispersible polymers, waxes, oils or fatty soaps; and (4) bleach activators having R—(C═O)-L wherein R is an alkyl group, optionally branched, having, when the bleach activator is hydrophobic, from 6 to 14 carbon atoms, or from 8 to 12 carbon atoms and, when the bleach activator is hydrophilic, less than 6 carbon atoms or even less than 4 carbon atoms; and L is leaving group. Examples of suitable leaving groups are benzoic acid and derivatives thereof—especially benzene sulphonate. Suitable bleach activators include dodecanoyl oxybenzene sulphonate, decanoyl oxybenzene sulphonate, decanoyl oxybenzoic acid or salts thereof, 3,5,5-trimethyl hexanoyloxybenzene sulphonate, tetraacetyl ethylene diamine (TAED) and nonanoyloxybenzene sulphonate (NOBS). Suitable bleach activators are also disclosed in WO 98/17767. While any suitable bleach activator may be employed, in one aspect of the invention the subject cleaning composition may comprise NOBS, TAED or mixtures thereof.

When present, the peracid and/or bleach activator is generally present in the composition in an amount of from about 0.1 to about 60 wt %, from about 0.5 to about 40 wt % or even from about 0.6 to about 10 wt % based on the composition. One or more hydrophobic peracids or precursors thereof may be used in combination with one or more hydrophilic peracid or precursor thereof.

The amounts of hydrogen peroxide source and peracid or bleach activator may be selected such that the molar ratio of available oxygen (from the peroxide source) to peracid is from 1:1 to 35:1, or even 2:1 to 10:1.

Surfactants—The cleaning compositions according to the present invention may comprise a surfactant or surfactant system wherein the surfactant can be selected from nonionic surfactants, anionic surfactants, cationic surfactants, ampholytic surfactants, zwitterionic surfactants, semi-polar nonionic surfactants and mixtures thereof. When present, surfactant is typically present at a level of from about 0.1% to about 60%, from about 1% to about 50% or even from about 5% to about 40% by weight of the subject composition.

Builders—The cleaning compositions of the present invention may comprise one or more detergent builders or builder systems. When a builder is used, the subject composition will typically comprise at least about 1%, from about 5% to about 60% or even from about 10% to about 40% builder by weight of the subject composition.

Builders include, but are not limited to, the alkali metal, ammonium and alkanolammonium salts of polyphosphates, alkali metal silicates, alkaline earth and alkali metal carbonates, aluminosilicate builders and polycarboxylate compounds, ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, citric acid, oxydisuccinic acid, polymaleic acid, benzene 1,3,5-tricarboxylic acid, carboxymethyloxysuccinic acid, and soluble salts thereof.

Chelating Agents—The cleaning compositions herein may contain a chelating agent. Suitable chelating agents include copper, iron and/or manganese chelating agents and mixtures thereof. When a chelating agent is used, the subject composition may comprise from about 0.005% to about 15% or even from about 3.0% to about 10% chelating agent by weight of the subject composition.

Dye Transfer Inhibiting Agents—The cleaning compositions of the present invention may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof. When present in a subject composition, the dye transfer inhibiting agents may be present at levels from about 0.0001% to about 10%, from about 0.01% to about 5% or even from about 0.1% to about 3% by weight of the composition.

Fluorescent whitening agent—The cleaning compositions of the present invention will preferably also contain additional components that may tint articles being cleaned, such as fluorescent whitening agent. Any fluorescent whitening agent suitable for use in a laundry detergent composition may be used in the composition of the present invention. The most commonly used fluorescent whitening agents are those belonging to the classes of diaminostilbene-sulphonic acid derivatives, diarylpyrazoline derivatives and bisphenyldistyryl derivatives. Examples of the diaminostilbene-sulphonic acid derivative type of fluorescent whitening agents include the sodium salts of:

4,4'-bis-(2-diethanolamine-4-aniline-s-triazin-6-ylamino) stilbene-2,2'-disulphonate, 4,4'-bis-(2,4-dianilino-s-triazin-6-ylamino) stilbene-2,2'-disulphonate, 4,4'-bis-(2-anilino-4(N-methyl-N-2-hydroxy-ethylamino)-s-triazin-6-ylamino) stilbene-2,2'-disulphonate, 4,4'-bis-(4-phenyl-2,1,3-triazol-2-yl)stilbene-2,2'-disulphonate, 4,4'-bis-(2-anilino-4(1-methyl-2-hydroxy-ethylamino)-s-triazin-6-ylamino) stilbene-2,2'-disulphonate and, 2-(stilbyl-4"-naptho-1,2':4,5)-1,2,3-trizole-2"-sulphonate.

Preferred fluorescent whitening agents are Tinopal® DMS and Tinopal® CBS available from Ciba-Geigy AG, Basel, Switzerland. Tinopal® DMS is the disodium salt of 4,4'-bis-(2-morpholino-4 anilino-s-triazin-6-ylamino) stilbene disulphonate. Tinopal® CBS is the disodium salt of 2,2'-bis-(phenyl-styryl) disulphonate.

Also preferred are fluorescent whitening agents of the structure:

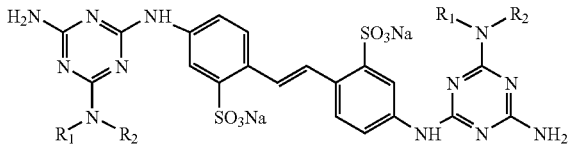

wherein R1 and R2, together with the nitrogen atom linking them, form an unsubstituted or C1-C4 alkyl-substituted morpholino, piperidine or pyrrolidine ring, preferably a morpholino ring (commercially available as Parawhite KX, supplied by Paramount Minerals and Chemicals, Mumbai, India)

Other fluorescers suitable for use in the invention include the 1-3-diaryl pyrazolines and the 7-alkylaminocoumarins.

Suitable fluorescent brightener levels include lower levels of from about 0.01, from about 0.05, from about 0.1 or even from about 0.2 wt % to upper levels of 0.5 or even 0.75 wt %.

Dispersants—The compositions of the present invention can also contain dispersants. Suitable water-soluble organic materials include the homo- or co-polymeric acids or their salts, in which the polycarboxylic acid comprises at least two carboxyl radicals separated from each other by not more than two carbon atoms.

Enzymes—In addition to the bacterial alkaline endoglucanase, the cleaning compositions can comprise one or more other enzymes which provide cleaning performance and/or fabric care benefits. Examples of suitable enzymes include, but are not limited to, hemicellulases, peroxidases, proteases, other cellulases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. In a preferred embodiment, the compositions of the present invention will further comprise a lipase, for further improved cleaning and whitening performance. A typical combination is an enzyme cocktail that may comprise, for example, a protease and lipase in conjunction with amylase. When present in a cleaning composition, the aforementioned additional enzymes may be present at levels from about 0.00001% to about 2%, from about 0.0001% to about 1% or even from about 0.001% to about 0.5% enzyme protein by weight of the composition.

Enzyme Stabilizers—Enzymes for use in detergents can be stabilized by various techniques. The enzymes employed herein can be stabilized by the presence of water-soluble sources of calcium and/or magnesium ions in the finished compositions that provide such ions to the enzymes. In case of aqueous compositions comprising protease, a reversible protease inhibitor, such as a boron compound, can be added to further improve stability.

Catalytic Metal Complexes—Applicants' cleaning compositions may include catalytic metal complexes. One type of metal-containing bleach catalyst is a catalyst system comprising a transition metal cation of defined bleach catalytic activity, such as copper, iron, titanium, ruthenium, tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra(methylenephosphonic acid) and water-soluble salts thereof. Such catalysts are disclosed in U.S. Pat. No. 4,430,243.

If desired, the compositions herein can be catalyzed by means of a manganese compound. Such compounds and levels of use are well known in the art and include, for example, the manganese-based catalysts disclosed in U.S. Pat. No. 5,576,282.

Cobalt bleach catalysts useful herein are known, and are described, for example, in U.S. Pat. Nos. 5,597,936; 5,595,967. Such cobalt catalysts are readily prepared by known procedures, such as taught for example in U.S. Pat. Nos. 5,597,936, and 5,595,967.

Compositions herein may also suitably include a transition metal complex of ligands such as bispidones (WO 05/042532 A1) and/or macropolycyclic rigid ligands—abbreviated as "MRLs". As a practical matter, and not by way of limitation, the compositions and processes herein can be adjusted to provide on the order of at least one part per hundred million of the active MRL species in the aqueous washing medium, and will typically provide from about 0.005 ppm to about 25 ppm, from about 0.05 ppm to about 10 ppm, or even from about 0.1 ppm to about 5 ppm, of the MRL in the wash liquor.

Suitable transition-metals in the instant transition-metal bleach catalyst include, for example, manganese, iron and chromium. Suitable MRLs include 5,12-diethyl-1,5,8,12-tetraazabicyclo[6.6.2]hexadecane.

Suitable transition metal MRLs are readily prepared by known procedures, such as taught for example in WO 00/32601, and U.S. Pat. No. 6,225,464.

Solvents—Suitable solvents include water and other solvents such as lipophilic fluids. Examples of suitable lipophilic fluids include siloxanes, other silicones, hydrocarbons, glycol ethers, glycerine derivatives such as glycerine ethers, perfluorinated amines, perfluorinated and hydrofluoroether solvents, low-volatility nonfluorinated organic solvents, diol solvents, other environmentally-friendly solvents and mixtures thereof.

Softening system—the compositions of the invention may comprise a softening agent such as clay and optionally also with flocculants and enzymes; optionally for softening through the wash.

Processes of Making Compositions

The compositions of the present invention can be formulated into any suitable form and prepared by any process chosen by the formulator, non-limiting examples of which are described in Applicants' examples and in U.S. Pat. No. 4,990,280; U.S. 20030087791A1; U.S. 20030087790A1; U.S. 20050003983A1; U.S. 20040048764A1; U.S. Pat. Nos. 4,762,636; 6,291,412; U.S. 20050227891A1; EP 1070115A2; U.S. Pat. Nos. 5,879,584; 5,691,297; 5,574,005; 5,569,645; 5,565,422; 5,516,448; 5,489,392; 5,486,303 all of which are incorporated herein by reference.

Method of Use

The present invention includes a method for laundering a fabric. The method comprises the steps of contacting a fabric to be laundered with a said cleaning laundry solution comprising at least one embodiment of Applicants' cleaning composition, cleaning additive or mixture thereof. The fabric may comprise most any fabric capable of being laundered in normal consumer use conditions. The solution preferably has a pH of from about 8 to about 10.5. The compositions may be employed at concentrations of from about 500 ppm to about 15,000 ppm in solution. The water temperatures typically range from about 5° C. to about 90° C. The water to fabric ratio is typically from about 1:1 to about 30:1.

Test Method 1

Fabric hueing agents are known to those skilled in the art and are described in the present specification. In one non-limiting aspect, suitable fabric hueing agents may be defined by the following test:

1) Fill two tergotometer pots with 800 ml of Newcastle upon Tyne, UK, City Water (~12 grains per US gallon total hardness, supplied by Northumbrian Water, Pity Me, Durham, Co. Durham, UK).
2) Insert pots into tergotometer, with water temperature controlled at 30° C. and agitation set at 40 rpm for the duration of the experiment
3) Add 4.8 g of IEC-B detergent (IEC 60456 Washing Machine Reference Base Detergent Type B), supplied by wfk, Brüggen-Bracht, Germany, to each pot.
4) After two minutes, add 2.0 mg active colorant to the first pot.
5) After one minute, add 50 g of flat cotton vest (supplied by Warwick Equest, Consett, County Durham, UK), cut into 5 cm×5 cm swatches, to each pot.
6) After 10 minutes, drain the pots and re-fill with cold Newcastle upon Tyne City Water (16° C.)
7) After 2 minutes rinsing, remove fabrics
8) Repeat steps 3-7 for a further three cycles using the same treatments
9) Collect and line dry the fabrics indoors for 12 hours
10) Analyse the swatches using a Hunter Miniscan spectrometer fitted with D65 illuminant and UVA cutting filter, to obtain Hunter a (red-green axis) and Hunter b (yellow-blue axis) values.
11) Average the Hunter a and Hunter b values for each set of fabrics. If the fabrics treated with colorant under assessment show an average difference in hue of greater than 0.2 units on either the a axis or b axis, it is deemed to be a fabric hueing agent for the purpose of the invention.

EXAMPLES

Unless otherwise indicated, materials can be obtained from Aldrich, P.O. Box 2060, Milwaukee, Wis. 53201, USA.

Examples 1-6

Granular laundry detergent compositions designed for handwashing or top-loading washing machines.

| | 1 (wt %) | 2 (wt %) | 3 (wt %) | 4 (wt %) | 5 (wt %) | 6 (wt %) |
|---|---|---|---|---|---|---|
| Linear alkylbenzenesulfonate | 20 | 22 | 20 | 15 | 20 | 20 |
| $C_{12-14}$ Dimethylhydroxyethyl ammonium chloride | 0.7 | 1 | 1 | 0.6 | 0.0 | 0.7 |
| AE3S | 0.9 | 0.0 | 0.9 | 0.0 | 0.0 | 0.9 |
| AE7 | 0.0 | 0.5 | 0.0 | 1 | 3 | 1 |
| Sodium tripolyphosphate | 23 | 30 | 23 | 5 | 12 | 23 |
| Zeolite A | 0.0 | 0.0 | 1.2 | 0.0 | 10 | 0.0 |
| 1.6R Silicate ($SiO_2$:$Na_2O$ at rat 1.6:1) | 7 | 7 | 7 | 7 | 7 | 7 |
| Sodium Carbonate | 15 | 14 | 15 | 18 | 15 | 15 |
| Polyacrylate MW 4500 | 1 | 0.0 | 1 | 1 | 1.5 | 1 |
| Carboxy Methyl Cellulose | 0.2 | 0.3 | 0.3 | 0.3 | 0.4 | 0.2 |
| Savinase ® 32.89 mg/g | 0.1 | 0.07 | 0.1 | 0.1 | 0.1 | 0.1 |
| Natalase ® 8.65 mg/g | 0.1 | 0.1 | 0.1 | 0.0 | 0.1 | 0.1 |
| Endoglucanase 15.6 mg/g | 0.03 | 0.07 | 0.3 | 0.1 | 0.07 | 0.4 |
| Fluorescent Brightener 1 | 0.06 | 0.0 | 0.06 | 0.18 | 0.06 | 0.06 |
| Fluorescent Brightener 2 | 0.1 | 0.06 | 0.1 | 0.0 | 0.1 | 0.1 |
| Diethylenetriamine pentaacetic acid | 0.6 | 0.3 | 0.6 | 0.25 | 0.6 | 0.6 |
| $MgSO_4$ | 1 | 1 | 1 | 0.5 | 1 | 1 |

-continued

| | 1 (wt %) | 2 (wt %) | 3 (wt %) | 4 (wt %) | 5 (wt %) | 6 (wt %) |
|---|---|---|---|---|---|---|
| Sodium Percarbonate | 0.0 | 5.2 | 0.1 | 0.0 | 0.0 | 0.0 |
| Sodium Perborate Monohydrate | 4.4 | 0.0 | 3.85 | 2.09 | 0.78 | 3.63 |
| NOBS | 1.9 | 0.0 | 1.66 | — | 0.33 | 0.75 |
| TAED | 0.58 | 1.2 | 0.51 | — | 0.015 | 0.28 |
| Sulphonated zinc phthalocyanine | 0.0030 | — | 0.0012 | 0.0030 | 0.0021 | — |
| S-ACMC | 0.1 | 0.06 | — | — | — | |
| Direct Violet 9 | — | — | 0.0003 | 0.0005 | 0.0003 | — |
| Ultramarine Blue | — | — | — | — | — | 0.2 |
| Sulfate/Moisture | Balance to 100% | Balance to 100% | Balance to 100% | Balance to 100% | Balance to 100% | Balance to 100% |

Any of the above compositions is used to launder fabrics at a concentration of 600-1000 ppm in water, with typical median conditions of 2500 ppm, 25° C., and a 25:1 water:cloth ratio.

Any of the above compositions is used to launder fabrics at a concentration of 600-10000 ppm in water, with typical median conditions of 2500 ppm, 25° C., and a 25:1 water: cloth ratio.

Examples 7-10

Granular laundry detergent compositions designed for front-loading automatic washing machines.

| | 7 (wt %) | 8 (wt %) | 9 (wt %) | 10 (wt %) |
|---|---|---|---|---|
| Linear alkylbenzenesulfonate | 8 | 7.1 | 7 | 6.5 |
| AE3S | 0 | 4.8 | 0 | 5.2 |
| Alkylsulfate | 1 | 0 | 1 | 0 |
| AE7 | 2.2 | 0 | 3.2 | 0 |
| $C_{10-12}$ Dimethyl hydroxyethylammonium chloride | 0.75 | 0.94 | 0.98 | 0.98 |
| Crystalline layered silicate ($\delta$-$Na_2Si_2O_5$) | 4.1 | 0 | 4.8 | 0 |
| Zeolite A | 20 | 0 | 17 | 0 |
| Citric Acid | 3 | 5 | 3 | 4 |
| Sodium Carbonate | 15 | 20 | 14 | 20 |
| Silicate 2R ($SiO_2$:$Na_2O$ at ratio 2:1) | 0.08 | 0 | 0.11 | 0 |
| Soil release agent | 0.75 | 0.72 | 0.71 | 0.72 |
| Acrylic Acid/Maleic Acid Copolymer | 1.1 | 3.7 | 1.0 | 3.7 |
| Carboxymethylcellulose | 0.15 | 1.4 | 0.2 | 1.4 |
| Protease (56.00 mg active/g) | 0.37 | 0.4 | 0.4 | 0.4 |

-continued

| | 7 (wt %) | 8 (wt %) | 9 (wt %) | 10 (wt %) |
|---|---|---|---|---|
| Termamyl ® (21.55 mg active/g) | 0.3 | 0.3 | 0.3 | 0.3 |
| Endoglucanase 15.6 mg/g | 0.05 | 0.15 | 0.2 | 0.5 |
| Natalase ® (8.65 mg active/g) | 0.1 | 0.14 | 0.14 | 0.3 |
| TAED | 3.6 | 4.0 | 3.6 | 4.0 |
| Percarbonate | 13 | 13.2 | 13 | 13.2 |
| Na salt of Ethylenediamine-N,N'-disuccinic acid, (S,S) isomer (EDDS) | 0.2 | 0.2 | 0.2 | 0.2 |
| Hydroxyethane di phosphonate (HEDP) | 0.2 | 0.2 | 0.2 | 0.2 |
| $MgSO_4$ | 0.42 | 0.42 | 0.42 | 0.42 |
| Perfume | 0.5 | 0.6 | 0.5 | 0.6 |
| Suds suppressor agglomerate | 0.05 | 0.1 | 0.05 | 0.1 |
| Soap | 0.45 | 0.45 | 0.45 | 0.45 |
| Sodium sulfate | 22 | 33 | 24 | 30 |
| Sulphonated zinc phthalocyanine (active) | 0.0007 | 0.0012 | 0.0007 | — |
| S-ACMC | 0.01 | 0.01 | — | 0.01 |
| Direct Violet 9 (active) | — | — | 0.0001 | 0.0001 |
| Water & Miscellaneous | Balance to 100% | Balance to 100% | Balance to 100% | Balance to 100% |

Any of the above compositions is used to launder fabrics at a concentration of 10,000 ppm in water, 20-90° C., and a 5:1 water:cloth ratio. The typical pH is about 10.

Examples 11-16

Heavy Duty Liquid laundry detergent compositions

| | 11 (wt %) 100% SNOW | 12 (wt %) 100% SNOWBALL | 13 (wt %) 75% SNOW | 14 (wt %) 50% SNOWBALL | 15 (wt %) 100% SNOW (nil polymer) | 16 (wt %) 75% SNOW (Nil polymer) |
|---|---|---|---|---|---|---|
| AES $C_{12-15}$ alkyl ethoxy (1.8) sulfate | 11 | 10 | 4 | 6.32 | 6.0 | 8.2 |
| Linear alkyl benzene sulfonate | 4 | 0 | 8 | 3.3 | 4.0 | 3.0 |
| HSAS | 0 | 5.1 | 3 | 0 | 2 | 0 |
| Sodium formate | 1.6 | 0.09 | 1.2 | 0.04 | 1.6 | 1.2 |
| Sodium hydroxide | 2.3 | 3.8 | 1.7 | 1.9 | 2.3 | 1.7 |
| Monoethanolamine | 1.4 | 1.490 | 1.0 | 0.7 | 1.35 | 1.0 |
| Diethylene glycol | 5.5 | 0.0 | 4.1 | 0.0 | 5.500 | 4.1 |
| Nonionic | 0.4 | 0.6 | 0.3 | 0.3 | 2 | 0.3 |
| Chelant | 0.15 | 0.15 | 0.11 | 0.07 | 0.15 | 0.11 |
| Citric Acid | 2.5 | 3.96 | 1.88 | 1.98 | 2.5 | 1.88 |
| $C_{12-14}$ dimethyl Amine Oxide | 0.3 | 0.73 | 0.23 | 0.37 | 0.3 | 0.225 |
| $C_{12-18}$ Fatty Acid | 0.8 | 1.9 | 0.6 | 0.99 | 0.8 | 0.6 |
| Borax | 1.43 | 1.5 | 1.1 | 0.75 | 1.43 | 1.07 |

-continued

| | 11 (wt %) 100% SNOW | 12 (wt %) 100% SNOWBALL | 13 (wt %) 75% SNOW | 14 (wt %) 50% SNOWBALL | 15 (wt %) 100% SNOW (nil polymer) | 16 (wt %) 75% SNOW (Nil polymer) |
|---|---|---|---|---|---|---|
| Ethanol | 1.54 | 1.77 | 1.15 | 0.89 | 1.54 | 1.15 |
| Ethoxylated ($EO_{15}$) tetraethylene pentaimine[1] | 0.3 | 0.33 | 0.23 | 0.17 | 0.0 | 0.0 |
| Ethoxylated hexamethylene diamine[2] | 0.8 | 0.81 | 0.6 | 0.4 | 0.0 | 0.0 |
| 1,2-Propanediol | 0.0 | 6.6 | 0.0 | 3.3 | 0.0 | 0.0 |
| Liquanase ®* | 36.4 | 36.4 | 27.3 | 18.2 | 36.4 | 27.3 |
| Mannaway ® * | 1.1 | 1.1 | 0.8 | 0.6 | 1.1 | 0.8 |
| Natalase ®* | 7.3 | 7.3 | 5.5 | 3.7 | 7.3 | 5.5 |
| Endoglucanase* | 10 | 3.2 | 1 | 3.2 | 2.4 | 3.2 |
| Liquitint ® Violet CT (active) | 0.006 | 0.002 | — | — | — | 0.002 |
| S-ACMC | — | — | 0.01 | 0.05 | 0.01 | 0.02 |
| Water, perfume, dyes & other components | Balance | Balance | Balance | Balance | Balance | Balance |

Raw Materials and Notes for Composition Examples 1-16

Linear alkylbenzenesulfonate having an average aliphatic carbon chain length $C_{11}$-$C_{12}$ supplied by Stepan, Northfield, Ill., USA $C_{12-14}$ Dimethylhydroxyethyl ammonium chloride, supplied by Clariant GmbH, Sulzbach, Germany AE3S is $C_{12-15}$ alkyl ethoxy (3) sulfate supplied by Stepan, Northfield, Ill., USA AE7 is $C_{12-15}$ alcohol ethoxylate, with an average degree of ethoxylation of 7, supplied by Huntsman, Salt Lake City, Utah, USA Sodium tripolyphosphate is supplied by Rhodia, Paris, France Zeolite A was supplied by Industrial Zeolite (UK) Ltd, Grays, Essex, UK 1.6R Silicate was supplied by Koma, Nestemica, Czech Republic Sodium Carbonate was supplied by Solvay, Houston, Tex., USA Polyacrylate MW 4500 is supplied by BASF, Ludwigshafen, Germany Carboxy Methyl Cellulose is Finnfix® BDA supplied by CPKelco, Arnhem, Netherlands Savinase®, Natalase®, Termamyl®, Mannaway® and Liquanase® supplied by Novozymes, Bagsvaerd, Denmark Endoglucanase: Celluclean®, supplied by Novozymes, Bagsvaerd, Denmark Fluorescent Brightener 1 is Tinopal® AMS, Fluorescent Brightener 2 is Tinopal® CBS-X, Sulphonated zinc phthalocyanine and Direct Violet 9 was Pergasol® Violet BN-Z all supplied by Ciba Specialty Chemicals, Basel, Switzerland Diethylenetriamine pentacetic acid was supplied by Dow Chemical, Midland, Mich., USA Sodium percarbonate supplied by Solvay, Houston, Tex., USA Sodium perborate was supplied by Degussa, Hanau, Germany NOBS is sodium nonanoyloxybenzenesulfonate, supplied by Eastman, Batesville, Ark., USA TAED is tetraacetylethylenediamine, supplied under the Peractive® brand name by Clariant GmbH, Sulzbach, Germany S-ACMC is carboxymethylcellulose conjugated with C.I. Reactive Blue 19, sold by Megazyme, Wicklow, Ireland under the product name AZO-CM-CELLULOSE, product code S-ACMC.

Ultramarine Blue was supplied by Holliday Pigments, Kingston upon Hull, UK

Soil release agent is Repel-o-tex® PF, supplied by Rhodia, Paris, France

Acrylic Acid/Maleic Acid Copolymer is molecular weight 70,000 and acrylate:maleate ratio 70:30, supplied by BASF, Ludwigshafen, Germany Protease described in patent application U.S. Pat. No. 6,312,936B1 supplied by Genencor International, Palo Alto, Calif., USA Na salt of Ethylenediamine-N,N'-disuccinic acid, (S,S) isomer (EDDS) was supplied by Octel, Ellesmere Port, UK Hydroxyethane di phosphonate (HEDP) was supplied by Dow Chemical, Midland, Mich., USA Suds suppressor agglomerate was supplied by Dow Corning, Midland, Mich., USA HSAS is mid-branched alkyl sulfate as disclosed in U.S. Pat. Nos. 6,020,303 and 6,060,443

$C_{12-14}$ dimethyl Amine Oxide was supplied by Procter & Gamble Chemicals, Cincinnati, Ohio, USA Nonionic is preferably a $C_{12}$-$C_{13}$ ethoxylate, preferably with an av degree of ethoxylation of 9.

Liquitint® Violet CT was supplied by Milliken, Spartanburg, S.C., USA)

* Numbers quoted in mg enzyme/100 g

[1] as described in U.S. Pat. No. 4,597,898.

[2] available under the tradename LUTENSIT® from BASF and such as those described in WO 01/05874

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

SEQUENCE LISTING

```
<160> NUMBER OF SEQ ID NOS: 2

<210> SEQ ID NO 1
<211> LENGTH: 773
<212> TYPE: PRT
<213> ORGANISM: Bacillus sp. AA349 DSM 12648

<400> SEQUENCE: 1

Ala Glu Gly Asn Thr Arg Glu Asp Asn Phe Lys His Leu Leu Gly Asn
1               5                   10                  15

Asp Asn Val Lys Arg Pro Ser Glu Ala Gly Ala Leu Gln Leu Gln Glu
            20                  25                  30

Val Asp Gly Gln Met Thr Leu Val Asp Gln His Gly Glu Lys Ile Gln
        35                  40                  45

Leu Arg Gly Met Ser Thr His Gly Leu Gln Trp Phe Pro Glu Ile Leu
    50                  55                  60

Asn Asp Asn Ala Tyr Lys Ala Leu Ala Asn Asp Trp Glu Ser Asn Met
65                  70                  75                  80

Ile Arg Leu Ala Met Tyr Val Gly Glu Asn Gly Tyr Ala Ser Asn Pro
                85                  90                  95

Glu Leu Ile Lys Ser Arg Val Ile Lys Gly Ile Asp Leu Ala Ile Glu
            100                 105                 110

Asn Asp Met Tyr Val Ile Val Asp Trp His Val His Ala Pro Gly Asp
        115                 120                 125

Pro Arg Asp Pro Val Tyr Ala Gly Ala Glu Asp Phe Phe Arg Asp Ile
    130                 135                 140

Ala Ala Leu Tyr Pro Asn Asn Pro His Ile Ile Tyr Glu Leu Ala Asn
145                 150                 155                 160

Glu Pro Ser Ser Asn Asn Asn Gly Gly Ala Gly Ile Pro Asn Asn Glu
                165                 170                 175

Glu Gly Trp Asn Ala Val Lys Glu Tyr Ala Asp Pro Ile Val Glu Met
            180                 185                 190

Leu Arg Asp Ser Gly Asn Ala Asp Asp Asn Ile Ile Ile Val Gly Ser
        195                 200                 205

Pro Asn Trp Ser Gln Arg Pro Asp Leu Ala Ala Asp Asn Pro Ile Asn
    210                 215                 220

Asp His His Thr Met Tyr Thr Val His Phe Tyr Thr Gly Ser His Ala
225                 230                 235                 240

Ala Ser Thr Glu Ser Tyr Pro Pro Glu Thr Pro Asn Ser Glu Arg Gly
                245                 250                 255

Asn Val Met Ser Asn Thr Arg Tyr Ala Leu Glu Asn Gly Val Ala Val
            260                 265                 270

Phe Ala Thr Glu Trp Gly Thr Ser Gln Ala Asn Gly Asp Gly Gly Pro
        275                 280                 285

Tyr Phe Asp Glu Ala Asp Val Trp Ile Glu Phe Leu Asn Glu Asn Asn
    290                 295                 300

Ile Ser Trp Ala Asn Trp Ser Leu Thr Asn Lys Asn Glu Val Ser Gly
305                 310                 315                 320
```

```
Ala Phe Thr Pro Phe Glu Leu Gly Lys Ser Asn Ala Thr Asn Leu Asp
                325                 330                 335

Pro Gly Pro Asp His Val Trp Ala Pro Glu Glu Leu Ser Leu Ser Gly
            340                 345                 350

Glu Tyr Val Arg Ala Arg Ile Lys Gly Val Asn Tyr Glu Pro Ile Asp
        355                 360                 365

Arg Thr Lys Tyr Thr Lys Val Leu Trp Asp Phe Asn Asp Gly Thr Lys
    370                 375                 380

Gln Gly Phe Gly Val Asn Ser Asp Ser Pro Asn Lys Glu Leu Ile Ala
385                 390                 395                 400

Val Asp Asn Glu Asn Asn Thr Leu Lys Val Ser Gly Leu Asp Val Ser
                405                 410                 415

Asn Asp Val Ser Asp Gly Asn Phe Trp Ala Asn Ala Arg Leu Ser Ala
            420                 425                 430

Asp Gly Trp Gly Lys Ser Val Asp Ile Leu Gly Ala Glu Lys Leu Thr
        435                 440                 445

Met Asp Val Ile Val Asp Glu Pro Thr Thr Val Ala Ile Ala Ala Ile
    450                 455                 460

Pro Gln Ser Ser Lys Ser Gly Trp Ala Asn Pro Glu Arg Ala Val Arg
465                 470                 475                 480

Val Asn Ala Glu Asp Phe Val Gln Gln Thr Asp Gly Lys Tyr Lys Ala
                485                 490                 495

Gly Leu Thr Ile Thr Gly Glu Asp Ala Pro Asn Leu Lys Asn Ile Ala
            500                 505                 510

Phe His Glu Glu Asp Asn Asn Met Asn Asn Ile Ile Leu Phe Val Gly
        515                 520                 525

Thr Asp Ala Ala Asp Val Ile Tyr Leu Asp Asn Ile Lys Val Ile Gly
    530                 535                 540

Thr Glu Val Glu Ile Pro Val Val His Asp Pro Lys Gly Glu Ala Val
545                 550                 555                 560

Leu Pro Ser Val Phe Glu Asp Gly Thr Arg Gln Gly Trp Asp Trp Ala
                565                 570                 575

Gly Glu Ser Gly Val Lys Thr Ala Leu Thr Ile Glu Glu Ala Asn Gly
            580                 585                 590

Ser Asn Ala Leu Ser Trp Glu Phe Gly Tyr Pro Glu Val Lys Pro Ser
        595                 600                 605

Asp Asn Trp Ala Thr Ala Pro Arg Leu Asp Phe Trp Lys Ser Asp Leu
    610                 615                 620

Val Arg Gly Glu Asn Asp Tyr Val Ala Phe Asp Phe Tyr Leu Asp Pro
625                 630                 635                 640

Val Arg Ala Thr Glu Gly Ala Met Asn Ile Asn Leu Val Phe Gln Pro
                645                 650                 655

Pro Thr Asn Gly Tyr Trp Val Gln Ala Pro Lys Thr Tyr Thr Ile Asn
            660                 665                 670

Phe Asp Glu Leu Glu Glu Ala Asn Gln Val Asn Gly Leu Tyr His Tyr
        675                 680                 685

Glu Val Lys Ile Asn Val Arg Asp Ile Thr Asn Ile Gln Asp Asp Thr
    690                 695                 700

Leu Leu Arg Asn Met Met Ile Ile Phe Ala Asp Val Glu Ser Asp Phe
705                 710                 715                 720

Ala Gly Arg Val Phe Val Asp Asn Val Arg Phe Glu Gly Ala Ala Thr
                725                 730                 735
```

```
Thr Glu Pro Val Glu Pro Glu Pro Val Asp Pro Gly Glu Glu Thr Pro
            740                 745                 750

Pro Val Asp Glu Lys Glu Ala Lys Lys Glu Gln Lys Glu Ala Glu Lys
        755                 760                 765

Glu Glu Lys Glu Glu
    770


<210> SEQ ID NO 2
<211> LENGTH: 824
<212> TYPE: PRT
<213> ORGANISM: Bacillus sp. KSMS237 FERM P-16067

<400> SEQUENCE: 2

Met Met Leu Arg Lys Lys Thr Lys Gln Leu Ile Ser Ser Ile Leu Ile
1               5                   10                  15

Leu Val Leu Leu Leu Ser Leu Phe Pro Ala Ala Leu Ala Ala Glu Gly
            20                  25                  30

Asn Thr Arg Glu Asp Asn Phe Lys His Leu Leu Gly Asn Asp Asn Val
        35                  40                  45

Lys Arg Pro Ser Glu Ala Gly Ala Leu Gln Leu Gln Glu Val Asp Gly
    50                  55                  60

Gln Met Thr Leu Val Asp Gln His Gly Glu Lys Ile Gln Leu Arg Gly
65                  70                  75                  80

Met Ser Thr His Gly Leu Gln Trp Phe Pro Glu Ile Leu Asn Asp Asn
                85                  90                  95

Ala Tyr Lys Ala Leu Ser Asn Asp Trp Asp Ser Asn Met Ile Arg Leu
            100                 105                 110

Ala Met Tyr Val Gly Glu Asn Gly Tyr Ala Thr Asn Pro Glu Leu Ile
        115                 120                 125

Lys Gln Arg Val Ile Asp Gly Ile Glu Leu Ala Ile Glu Asn Asp Met
    130                 135                 140

Tyr Val Ile Val Asp Trp His Val His Ala Pro Gly Asp Pro Arg Asp
145                 150                 155                 160

Pro Val Tyr Ala Gly Ala Lys Asp Phe Phe Arg Glu Ile Ala Ala Leu
                165                 170                 175

Tyr Pro Asn Asn Pro His Ile Ile Tyr Glu Leu Ala Asn Glu Pro Ser
            180                 185                 190

Ser Asn Asn Asn Gly Gly Ala Gly Ile Pro Asn Asn Glu Glu Gly Trp
        195                 200                 205

Lys Ala Val Lys Glu Tyr Ala Asp Pro Ile Val Glu Met Leu Arg Lys
    210                 215                 220

Ser Gly Asn Ala Asp Asp Asn Ile Ile Ile Val Gly Ser Pro Asn Trp
225                 230                 235                 240

Ser Gln Arg Pro Asp Leu Ala Ala Asp Asn Pro Ile Asp Asp His His
                245                 250                 255

Thr Met Tyr Thr Val His Phe Tyr Thr Gly Ser His Ala Ala Ser Thr
            260                 265                 270

Glu Ser Tyr Pro Ser Glu Thr Pro Asn Ser Glu Arg Gly Asn Val Met
        275                 280                 285

Ser Asn Thr Arg Tyr Ala Leu Glu Asn Gly Val Ala Val Phe Ala Thr
    290                 295                 300

Glu Trp Gly Thr Ser Gln Ala Ser Gly Asp Gly Gly Pro Tyr Phe Asp
305                 310                 315                 320

Glu Ala Asp Val Trp Ile Glu Phe Leu Asn Glu Asn Asn Ile Ser Trp
                325                 330                 335
```

```
Ala Asn Trp Ser Leu Thr Asn Lys Asn Glu Val Ser Gly Ala Phe Thr
            340                 345                 350

Pro Phe Glu Leu Gly Lys Ser Asn Ala Thr Asn Leu Asp Pro Gly Pro
        355                 360                 365

Asp His Val Trp Ala Pro Glu Glu Leu Ser Leu Ser Gly Glu Tyr Val
    370                 375                 380

Arg Ala Arg Ile Lys Gly Val Asn Tyr Glu Pro Ile Asp Arg Thr Lys
385                 390                 395                 400

Tyr Thr Lys Val Leu Trp Asp Phe Asn Asp Gly Thr Lys Gln Gly Phe
                405                 410                 415

Gly Val Asn Ser Asp Ser Pro Asn Lys Glu Leu Ile Ala Val Asp Asn
            420                 425                 430

Glu Asn Asn Thr Leu Lys Val Ser Gly Leu Asp Val Ser Asn Asp Val
        435                 440                 445

Ser Asp Gly Asn Phe Trp Ala Asn Ala Arg Leu Ser Ala Asn Gly Trp
    450                 455                 460

Gly Lys Ser Val Asp Ile Leu Gly Ala Glu Lys Leu Thr Met Asp Val
465                 470                 475                 480

Ile Val Asp Glu Pro Thr Thr Val Ala Ile Ala Ala Ile Pro Gln Ser
                485                 490                 495

Ser Lys Ser Gly Trp Ala Asn Pro Glu Arg Ala Val Arg Val Asn Ala
            500                 505                 510

Glu Asp Phe Val Gln Gln Thr Asp Gly Lys Tyr Lys Ala Gly Leu Thr
        515                 520                 525

Ile Thr Gly Glu Asp Ala Pro Asn Leu Lys Asn Ile Ala Phe His Glu
    530                 535                 540

Glu Asp Asn Asn Met Asn Asn Ile Ile Leu Phe Val Gly Thr Asp Ala
545                 550                 555                 560

Ala Asp Val Ile Tyr Leu Asp Asn Ile Lys Val Ile Gly Thr Glu Val
                565                 570                 575

Glu Ile Pro Val Val His Asp Pro Lys Gly Glu Ala Val Leu Pro Ser
            580                 585                 590

Val Phe Glu Asp Gly Thr Arg Gln Gly Trp Asp Trp Ala Gly Glu Ser
        595                 600                 605

Gly Val Lys Thr Ala Leu Thr Ile Glu Glu Ala Asn Gly Ser Asn Ala
    610                 615                 620

Leu Ser Trp Glu Phe Gly Tyr Pro Glu Val Lys Pro Ser Asp Asn Trp
625                 630                 635                 640

Ala Thr Ala Pro Arg Leu Asp Phe Trp Lys Ser Asp Leu Val Arg Gly
                645                 650                 655

Glu Asn Asp Tyr Val Ala Phe Asp Phe Tyr Leu Asp Pro Val Arg Ala
            660                 665                 670

Thr Glu Gly Ala Met Asn Ile Asn Leu Val Phe Gln Pro Pro Thr Asn
        675                 680                 685

Gly Tyr Trp Val Gln Ala Pro Lys Thr Tyr Thr Ile Asn Phe Asp Glu
    690                 695                 700

Leu Glu Glu Ala Asn Gln Val Asn Gly Leu Tyr His Tyr Glu Val Lys
705                 710                 715                 720

Ile Asn Val Arg Asp Ile Thr Asn Ile Gln Asp Asp Thr Leu Leu Arg
                725                 730                 735

Asn Met Met Ile Ile Phe Ala Asp Val Glu Ser Asp Phe Ala Gly Arg
            740                 745                 750
```

-continued

```
Val Phe Val Asp Asn Val Arg Phe Glu Gly Ala Ala Thr Thr Glu Pro
        755                 760                 765

Val Glu Pro Glu Pro Val Asp Pro Gly Glu Glu Thr Pro Pro Val Asp
    770                 775                 780

Glu Lys Glu Ala Lys Lys Glu Gln Lys Glu Ala Glu Lys Glu Glu Lys
785                 790                 795                 800

Glu Ala Val Lys Glu Glu Lys Lys Glu Ala Lys Glu Glu Lys Lys Ala
                805                 810                 815

Val Lys Asn Glu Ala Lys Lys Lys
            820
```

What is claimed is:

1. A composition comprising:

a fabric-substantive hueing agent selected from the group consisting of small molecule dyes, polymeric dyes and mixtures thereof, and a bacterial alkaline enzyme exhibiting endo-beta-1,4-glucanase activity, wherein the enzyme comprises:

(i) an endoglucanase having the amino acid sequence of positions 1 to position 773 of SEQ ID NO:1 or a fragment thereof that has endo-beta-1,4-glucanase activity or (iii) mixtures thereof.

2. A composition according to claim 1 wherein the bacterial alkaline enzyme exhibiting endo-beta-1,4-glucanase activity is comprised at a level of from about 0.00005% to about 0.15% by weight of pure enzyme.

3. A composition according to claim 1 wherein said hueing agent is comprised at a level of from about 0.00003% to about 0.1% by weight.

4. A composition according to claim 1, wherein said small molecule dyes comprise Direct Violet 9, Direct Violet 35, Direct Violet 48, Direct Violet 51, Direct Violet 66, Direct Blue 1, Direct Blue 71, Direct Blue 80, Direct Blue 279, Acid Red 17, Acid Red 73, Acid Red 88, Acid Red 150, Acid Violet 15, Acid Violet 17, Acid Violet 24, Acid Violet 43, Acid Violet 49, Acid Blue 15, Acid Blue 17, Acid Blue 25, Acid Blue 29, Acid Blue 40, Acid Blue 45, Acid Blue 75, Acid Blue 80, Acid Blue 83, Acid Blue 90 and Acid Blue 113, Acid Black 1, Basic Violet 1, Basic Violet 3, Basic Violet 4, Basic Violet 10, Basic Violet 35, Basic Blue 3, Basic Blue 16, Basic Blue 22, Basic Blue 47, Basic Blue 66, Basic Blue 75, Basic Blue 159 and mixtures thereof, and said polymeric dyes comprise polymers containing conjugated chromogens, polymers with chromogens co-polymerised into the backbone of the polymer, and mixtures thereof.

5. A composition according to claim 3 comprising a small molecule dye comprising Acid Violet 17, Acid Violet 43, Acid Red 73, Acid Red 88, Acid Red 150, Acid Blue 25, Acid Blue 29, Acid Blue 45, Acid Blue 113, Acid Black 1, Direct Blue 1, Direct Blue 71, Direct Violet 51, and mixtures thereof.

6. A composition according to claim 3 comprising a small molecule dye comprising Acid Violet 17, Direct Blue 71, Direct Violet 51, Direct Blue 1, Acid Red 88, Acid Red 150, Acid Blue 29, Acid Blue 113 or mixtures thereof.

7. A composition according to claim 1 wherein said dye comprises sulfonated zinc phthalocyanine, sulfonated aluminium phthalocyanines, xanthene dyes and mixtures thereof.

8. A composition according to claim 1 wherein the fabric hueing agent is a dye-photobleach conjugate.

9. A composition according to claim 1 wherein said composition comprises a lipase enzyme.

* * * * *